United States Patent [19]

Schultz et al.

[11] 4,351,529

[45] Sep. 28, 1982

[54] RACKET HANDLE

[76] Inventors: Edward C. Schultz, 304 N. Ford, Fullerton, Calif. 92623; Robert K. Stevenson, 525 Princeton Cir. West, Fullerton, Calif. 92631

[21] Appl. No.: 199,072

[22] Filed: Oct. 20, 1980

[51] Int. Cl.[3] ..... A63B 49/00

[52] U.S. Cl. ..... 273/75; 273/76

[58] Field of Search ..... 273/67 R, 67 A, 67 DA, 273/72 R, 73 J, 75, 81.4

[56] References Cited

U.S. PATENT DOCUMENTS

| | | | |
|---|---|---|---|
| D. 178,866 | 10/1956 | Cole | 273/73 R X |
| 346,858 | 8/1886 | Moss | 273/75 |
| 412,479 | 10/1889 | Davis | 273/75 X |
| 1,291,464 | 1/1919 | Folliard | 273/67 R |
| 4,153,249 | 5/1979 | Plagenhoef | 273/75 X |

FOREIGN PATENT DOCUMENTS

| | | | |
|---|---|---|---|
| 17501 | of 1908 | United Kingdom | 273/75 |

*Primary Examiner*—Anton O. Oechsle

*Attorney, Agent, or Firm*—Christie, Parker & Hale

[57] ABSTRACT

A game racket with a gripping handle having an end with a forwardly extending radial enlargement disposed substantially on one side of a plane defined by strings or an equivalent striking surface of the racket. The upper surface and at least a portion of the rear surface of the handle end are substantially smooth and non-enlarged to avoid jamming into the palm or heel of the hand which would interfere with wrist-snap movement desirable in many racket strokes, and the enlarged front portion of the handle end prevents the handle from slipping out of the player's grasp.

9 Claims, 7 Drawing Figures

RACKET HANDLE

BACKGROUND OF THE INVENTION

This invention relates to an improved handgrip for game rackets. The invention is useful with stringed rackets as used in tennis, racquetball, squash, badminton and the like, and is also suitable for paddle-type rackets as used in paddleball, paddle tennis and deck tennis.

Conventional rackets are used in these sports are provided with handgrip handles (typically octagonal or oval in cross section) which are uniformly outwardly flared at the handle end. The resulting roughly annular bulge or rib extending around the entire periphery of the handle end provides a shoulder or stop to prevent the handle from slipping out of the user's grasp.

We have found that a uniform outward flare of the handle end is disadvantageous in that the flared portion "jams" into or interferes with the lower part of the palm or the heel of the hand when the handle is normally gripped. This is especially true in racket strokes such as the overhead service where a high degree of wrist snap is desired. The interference of the handle end with the hand decreases the power and spin which can be imparted on forehand, service, and overhead strokes, and lessens control over the ball particularly in the execution of spin-imparting strokes.

These problems are solved by our racket handle which is outwardly flared over only a portion of the periphery of the handle. This partial bulge or rib is adequate to provide the desired safety stop to keep the handle from slipping out of the player's hand, but the outward flare is eliminated on those faces of the handle which abut the palm or heel of the hand.

SUMMARY OF THE INVENTION

Briefly stated, this invention is directed to an improved handgrip handle for a game racket (such as a tennis racket) having a generally flat or planar striking surface for hitting a ball or other game projectile. In contrast to a conventional handle which has a rib or shoulder extending radially from the entire periphery of the handle end, the improved handle provides this radial extension in only the forwardly and downwardly facing surfaces of the handle when the racket is gripped for a level forehand stroke. Preferably, the handle is generally octagonal in cross section, and the radial extension of the partial shoulder is about one-fourth inch above the adjacent surface of the handle. In an alternative form, only the forwardly extending surfaces are radially extended at the handle end to provide a single racket which can be used by both right-and-left-handed players.

DESCRIPTION OF THE PREFERRED EMBODIMENT

Figure 1:
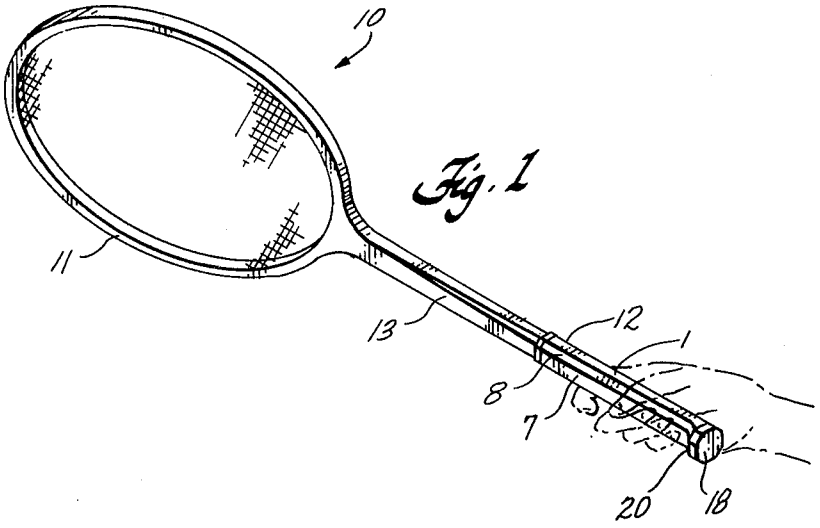
FIG. 1 is a pictorial view of a tennis racket incorporating the features of this invention.
Figure 2:
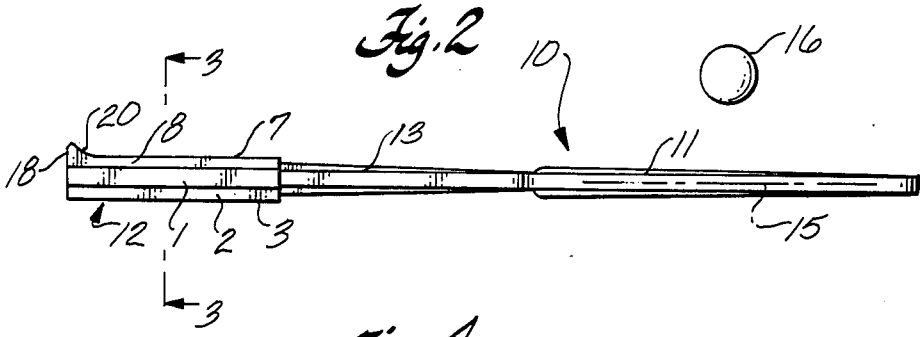
FIG. 2 is a top view of the racket positioned for a forehand stroke.
Figure 3:
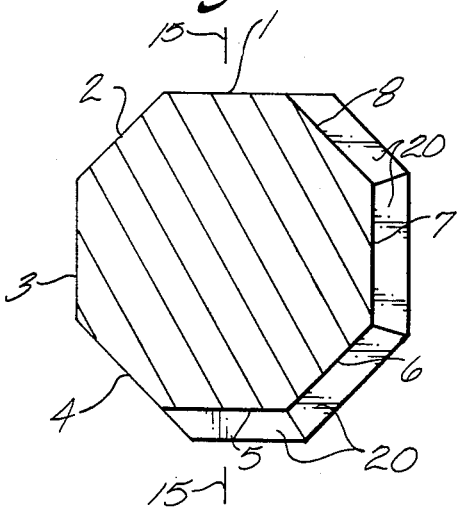
FIG. 3 is a sectional view on line 3—3 of FIG. 2.

Referring to FIGS. 1–3, a tennis racket 10 constructed according to the invention includes a stringed head 11, an elongated butt or handle 12, and a shank or throat section 13 joining the head and handle. The improvement of this invention is confined to the structure at the terminal end of handle 12, and the other parts of the racket are conventional. It is to be understood that the invention can be applied to any type of game racket, and the concept is not restricted to any particular style of racket for tennis or the other sports previously mentioned.

Handle 12 may be circular or oval in cross section, but most modern rackets are provided with a handle which has an elongated or irregular octagonal shape in cross section as shown in FIG. 3. The side surfaces of the main body of the handle are designated 1–8 in FIG. 3, and these numbers are arranged in counter-clockwise ascending order when viewing the handle in section toward its free or terminal end as shown in FIG. 3. The octagonal configuration is preferred for many styles of rackets because it enables rapid indexing of the handle within the player's grip to slightly different rotational positions for different types of strokes.

Surfaces 1 and 5 are at the top and bottom respectively of the handle when the racket is held for a normal relatively level forehand stroke against a ball 16 (FIG. 1). That is, these surfaces are perpendicular to a plane 15 defined by the stringed striking surface of the racket head. The front and rear faces of the racket handle are surfaces 7 and 3 respectively, and these surfaces are generally parallel to plane 15.

Remaining surfaces 2, 4, 6 and 8 are oriented at approximately 45 degrees to surfaces 1, 3, 5 and 7 to complete the generally octagonal configuration of the handle when seen in cross section. As is conventional in rackets of this type, rear surface 3 and front surface 7 are shown as being slightly wider than the other faces of the handle to provide a slightly oval or elongated octagonal handle configuration which fits the hand comfortably.

Beginning approximately one-half inch from a free end 18 of the handle, side surfaces 5, 6, 7 and 8 are outwardly flared to define an outwardly extending shoulder or bulge 20 which extends around about one-half of the periphery of the handle. As best seen in FIG. 3, bulge 20 is a smooth radial extension of surfaces 5–8, with the exception that the opposite ends of the bulge are formed to be in the same planes as defined by surfaces 1 and 4.

In a typical configuration, the narrower side surfaces of the racket handle are conventionally about one-half inch in width, and wider surfaces 3 and 7 are approximately $\frac{3}{4}$ inch in width. The radial extension of bulge 20 (taken with reference to the axial center line of the elongated handle) is preferably approximately 1/5 to $\frac{1}{4}$ inch beyond surfaces 5, 6, 7 and 8.

The material used for handle 12 is not critical, and may be wood, metal or a composition material configured to be conventionally joined with shank 13 of the racket. Preferably, the exterior of the handle is usually covered with a leather wrapping (not shown), and a cap (not shown) may be provided at end 18 to enable a neat termination of the leather wrapping as is conventional in tennis rackets. The end portion of the handle may also be formed as a separate slip-on cap which is useful to modify a conventional racket.

Figure 4:
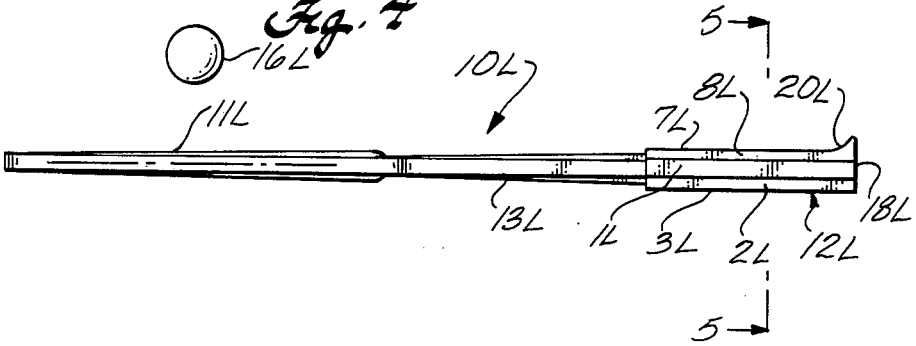
FIG. 4 is a top view of a tennis racket generally of the style shown in FIGS. 1–3, but modified for use by a left-handed player.
Figure 5:
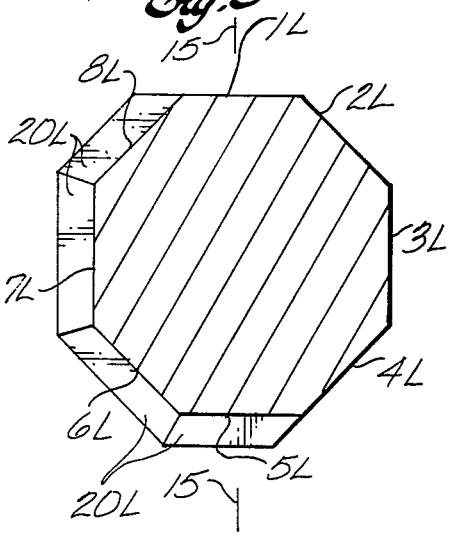
FIG. 5 is a sectional view on lines 5—5 of FIG. 4.
Figure 6:
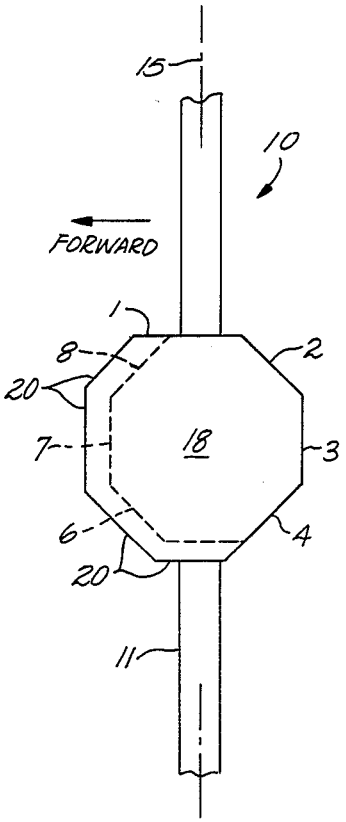
FIG. 6 is an end view of the racket taken from the racket-handle end.

Incorporation of the modified handle give the racket head a definite front surface (facing in the same direction as handle surface 7) used in forehand strokes, and a rear surface (facing in the same direction as handle surface 3) used in backhand strokes. The modified racket is also allochiral in that slightly different configurations are needed for right-handed and left-handed players. A left-handed racket 10L is shown in FIGS. 4–5, and the foregoing description applies equally to the left-handed version of the racket. It should be noted, however, that the numbered surfaces (which carry an "L" suffix in the left-handed version) ascend numerically in the opposite direction (clockwise) from those shown in FIG. 3.

Both the right-handed and left-handed versions of the tennis racket are characterized by a handle which terminates in outwardly flared faces on the bottom and forwardly facing surfaces of the handle. In both rackets, the bottom surface is surface 5, and the forwardly facing surfaces are surfaces 6, 7 and 8. The term "forwardly facing" is meant to designate the general direction of forehand stroke, and also those surfaces which face away from the palm of the hand when the racket is normally gripped.

Top surface 1 and at least rearwardly facing surfaces 2 and 3 (which are against the palm and heel of the hand in a normal grip) lack the outward flare of surfaces 5–8, and the end of the handle is substantially a smooth continuationof the general planes defined by surfaces 1–3. Elimination of the outward flare for surfaces 1–3 is adequate for certain grips, but the additional elimination of the flare of surface 4 is preferred as it enables rotation of the handle into a position referred to as a "Western forehand" which is used by many players.

The skewed terminal ends of the bulge or shoulder defined by extending the planes of surfaces 1 and 4 insure an adequate range of handle rotation within the player's grip to execute different types of strokes while still avoiding jamming of the shoulder into the hand. Substantially all of the shoulder (with the exception of a portion of the radial extension of surface 5) is forward of plane 15 defined by the racket striking surface, leaving the rear surfaces of the handle end free of a radial extension.

DESCRIPTION OF ALTERNATIVE EMBODIMENT

Figure 7:
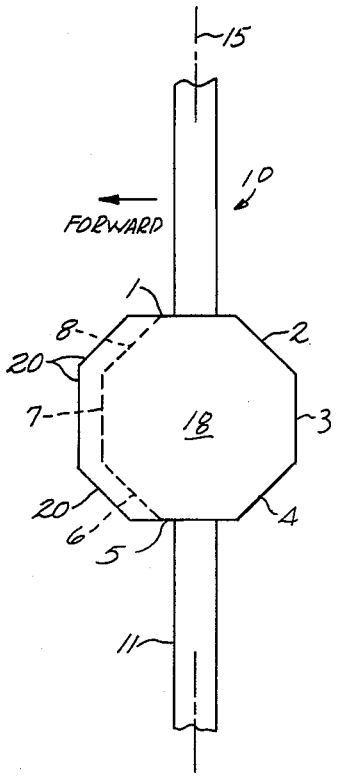
FIG. 7 is a view similar to FIG. 6, but showing a universal embodiment of a handle for the racket.

A possible disadvantage of the handle configurations described above is that different handles are required for right- and left-handed players. We have found that this problem can be eliminated without significant impairment of the advantages of the invention by forming the bulge 20 only on forwardly facing handle surfaces 6, 7, and 8, and by eliminating the radial enlargement of surface 5 as illustrated in FIG. 7.

In this modified "universal" configuration, bulge or shoulder 20 has opposite ends which are in the planes defined by surfaces 1 and 5. That is, side surface 5 as seen in FIG. 3 is flattened to have the same configuration as side surface 1.

We have found that elimination of approximately one-half or more of the continuously outwardly flared shoulder at the end of a conventional racket handle is effective in achieving better racket control for both increased power and improved execution of shots which impart spin to the ball. Any shot requiring wrist snap is capable of far better execution with the improved racket because the end of the handle does not jam into the palm or heel of the player's hand to interfere with the grip and overall racket control. The invention accordingly permits production of more effective and satisfactory rackets with substantially no increase in manufacturing cost.

What is claimed is:

1. A game racket, comprising a stringed head defining a generally planar surface for striking a ball, a shank extending from the head, and an elongated handgrip handle extending from the shank to terminate in an end portion, the handle having top and bottom surfaces which are generally perpendicular to the planar surface of the head, rearwardly facing surfaces which face the palm of the hand when the handle is gripped, and forwardly facing surfaces facing away from the palm and generally in the direction of a forehand stroke, the bottom and forwardly facing surfaces being outwardly flared at the end portion to define a partial shoulder at the handle end, and the top surface and the rearwardly facing surfaces adjacent to the top surface being smooth and substantially without outward flare in the end portion whereby the shoulder does not interfere with the palm of the hand while providing a bulged stop surface around a portion of the periphery of the handle end to resist handle slippage.

2. The racket defined in claim 1 wherein the handle is generally octagonal in cross section to define the top surface, the bottom surface, three forwardly facing surfaces, and three rearwardly facing surfaces.

3. The racket defined in claim 2 wherein the bottom and forwardly facing surfaces are outwardly flared about one-fourth inch at the end portion to define the partial shoulder.

4. The racket defined in claim 2 wherein an upper end of the shoulder terminates at a plane defined by the top surface, and a lower end of the shoulder terminates at a plane defined by an adjacent rearwardly facing surface.

5. A game racket, comprising an enlarged head with a generally planar surface for striking a game projectile, a shank section extending from one end of the racket head, and an elongated handle extending from the shank section to form a handgrip for the racket, said handle being comprised of surface portions including top and bottom portions generally perpendicular to a plane defined by the planar striking surface, and forward and rearward portions disposed on opposite sides of said plane, the handle having an end portion spaced from the shank, the end portion being radially enlarged with respect to the longitudinal axis of the handle to define a shoulder extending around about one-half the periphery of the end portion, a major part of the shoulder being disposed on one side of the plane defined by the planar striking surface but being not disposed outwardly with respect to said rearward portions, whereby the shoulder does not contact the heel of the user's hand when the handle is gripped with the heel at the handle end.

6. A game racket, comprising an enlarged head with a generally planar surface for striking a game ball, a shank section extending from the head, and an elongated handle extending from the shank section remote from the head to form a handgrip for the racket, the handle having a front side surface adapted for gripping by fingers of user's hand, and a rear side surface adapted to face and abut the palm of the hand, the handle further having a first end attached to the shank, and a second butt end remote from the shank, the handle being generally uniform in cross-sectional shape from the first end to the second end with the exception of an enlarged portion at the second end forming a radially enlarged shoulder extending around no more than one-half of the handle periphery, and extending from the front side surface away from the rear side surface so the shoulder does not contact the palm of the hand when the handle is gripped, the entire shoulder being forward of a plane defined by the planar striking surface of the racket.

7. A game racket, comprising a stringed head defining a generally planar surface for striking a ball, a shank extending from the head, and an elongated handgrip handle extending from the shank to an end portion, the handle having top and bottom surfaces which are generally perpendicular to the planar surface of the head, rearwardly facing surfaces which face the palm of the hand when the handle is gripped, and forwardly facing surfaces facing away from the palm and generally in the direction of a forehand stroke, at least portions of the forwardly facing surfaces being outwardly flared at the end portion to define a forwardly facing shoulder at the handle end, and the remaining surfaces being smooth and substantially without outward flare in the end portion whereby the shoulder does not interfere with the palm of the hand while providing a bulged stop surface around a portion of the periphery of the handle end to assist handle slippage.

8. The racket defined in claim 7 wherein the handle is generally octagonal in cross section to define the top surface, the bottom surface, three forwardly facing surfaces, and three rearwardly facing surfaces.

9. The racket defined in claim 8 wherein said portions of the forwardly facing surfaces are outwardly flared about one-fourth inch at the end portion to define the shoulder.

* * * * *

UNITED STATES PATENT AND TRADEMARK OFFICE

CERTIFICATE OF CORRECTION

PATENT NO. : 4,351,529

DATED : September 28, 1982

INVENTOR(S) : Edward C. Schultz and Robert K. Stevenson

It is certified that error appears in the above—identified patent and that said Letters Patent is hereby corrected as shown below:

Column 1, line 10, change "are" (first occurrence) to -- as --.

Column 3, line 25, after "of" insert -- a --.

Column 3, line 32, insert a space between the words "continuation" and "of."

Column 6, line 9, change "assist" to -- resist --.

Signed and Sealed this

*Twenty-fifth* Day of *January 1983*

[SEAL]

*Attest:*

GERALD J. MOSSINGHOFF

*Attesting Officer*

*Commissioner of Patents and Trademarks*